US006476776B1

(12) United States Patent
Kurby

(10) Patent No.: US 6,476,776 B1
(45) Date of Patent: Nov. 5, 2002

(54) SATELLITE ADAPTIVE ANTENNA SYSTEM

(75) Inventor: Christopher N. Kurby, Elmhurst, IL (US)

(73) Assignee: Motorola, Inc., Schaumburg, IL (US)

( * ) Notice: Subject to any disclaimer, the term of this patent is extended or adjusted under 35 U.S.C. 154(b) by 16 days.

(21) Appl. No.: 09/712,767

(22) Filed: Nov. 14, 2000

(51) Int. Cl.[7] ..... H01Q 1/24

(52) U.S. Cl. ..... 343/895; 343/702; 343/700 MS; 455/90

(58) Field of Search ..... 343/895, 725, 343/727, 700 MS, 702; 455/90; H01Q 1/24

(56) References Cited

U.S. PATENT DOCUMENTS

| | | | | |
|---|---|---|---|---|
| 6,016,122 A | | 1/2000 | Malone et al. | 342/372 |
| 6,018,651 A | | 1/2000 | Bruckert et al. | 455/277.1 |
| 6,023,615 A | | 2/2000 | Bruckert et al. | 455/277.2 |
| 6,175,334 B1 | * | 1/2001 | Vannatta et al. | 343/702 |
| 6,243,565 B1 | * | 6/2001 | Smith et al. | 455/101 |
| 6,326,924 B1 | * | 12/2001 | Muramoto et al. | 343/702 |

FOREIGN PATENT DOCUMENTS

| | | |
|---|---|---|
| WO | WO 99/41803 | 8/1999 |

* cited by examiner

*Primary Examiner*—Hoanganh Le
(74) *Attorney, Agent, or Firm*—Hisashi David Watanabe; Roland K. Bowler, II

(57) ABSTRACT

A satellite adapted antenna system has at least spaced apart first and second elements (104, 106), the first and second elements (104, 106) having substantially a common first polarization. A third element (108) has a second polarization that is opposite the first polarization of the first element (104). An antenna mode selector system selects between operatively connecting the first and second elements (104, 106) to form a specular antenna and operatively connecting the first and third elements (104, 108) to form a diversity antenna. Each of the first, second and third elements (104, 106, 108) are quadrifilar helix antennas. The first and second elements (104, 106) are quadrifilar helix antenna having right hand circuit polarization, and the third element (108) is a quadrifilar helix antenna having a left hand circuit polarization. The method for adapting a satellite antenna system has the steps of providing a diversity antenna having a polarization diversity mode defined by the first and third elements (104, 108); providing a specular antenna having a pattern gain mode defined by the first and second elements (104, 106); using the diversity mode for communicating with a satellite; and switching to the specular mode for communicating with the satellite in response to at least one predetermined characteristic.

24 Claims, 6 Drawing Sheets

SATELLITE ADAPTIVE ANTENNA SYSTEM

FIELD OF THE INVENTION

The invention relates generally to satellite antenna systems, and more particularly to an adaptive satellite antenna system for use on a radio subscriber unit.

BACKGROUND OF THE INVENTION

Many types of radio subscriber units, such as cell phones, incorporate circuitry for receiving signals from satellites, such as GPS (Global Positioning System) signals, as well as circuitry for communicating signals with satellites. Numerous antenna systems and configurations are known in the prior art. For example, an antenna system operating in a diversity mode has a first antenna and a second antenna. First and second signals of a composite radio frequency signal are received from the first and second antennas, respectively. The composite radio frequency signal includes a desired radio frequency signal as well as interfering signals. The ratio of the desired signal to the estimate of the composite radio frequency signal is determined in response to receiving the desired signal of the composite radio frequency signal and a signal representative of the composite radio frequency signal. A selected state of the first antenna and the second antenna is controlled as a function of the ratio and an integrated received signal is provided that is representative of the composite radio frequency signal. See, for example, U.S. Pat. No. 6,023,615. In a switched diversity antenna apparatus, such as disclosed in U.S. Pat. No. 6,018,651, a receiver is selectively coupled to the first antenna and/or the second antenna. A controller selectively couples the receiver in response to the received signal. In a switched antenna diversity apparatus the receiver may be attached to only one of the first or second antennas, or may be attached to both of the first and second antennas.

It is a drawback in the prior art that the above-described antenna systems only operate in a diversity mode.

Antenna systems are also known which are directional, referred to, for example, as directive pattern mode, pattern gain mode, specular mode, line of sight mode, etc. Such antennas have antenna patterns with lobes that define regions in the radiation pattern in which radiation is most intense or, in which reception is strongest. An antenna array is a directional antenna that consists of an assembly of properly dimensioned and spaced elements, such as radiators, directors and reflectors.

For each of diversity mode antennas and directional antennas, the antenna elements may take on various forms, such as patch antenna structures and helical antenna structures. These antennas can take the form of quadrifilar helix, and stack patched antennas. A quadrifilar helical antenna is a highly resonant antenna, and consists of four helical arms placed at 90 degrees to one another.

In a given environment several propagation modes can be experienced. A high attenuation mode is exemplified by lite in-building fading from buildings made, for example, of wood. In this situation relatively high losses cause a reduced link margin and possibly a loss of the link with the satellite. In a highly scattered environment, a quadrifilar helix antenna has reduced performance because the antenna does not provide any diversity gain. This can also lead to a loss of the link with the satellite.

In the prior art it is known for the transmission and reception of signals with satellites to use one element for transmission and a separate element for reception. However, the known antenna systems for radio subscriber units in the prior art develop problems with different locations and conditions (such as inside or outside of buildings) when receiving satellite signals. Accordingly, there exists a need for an antenna apparatus that can adapt to changing environmental conditions.

BRIEF DESCRIPTION OF THE DRAWINGS

The features of the present invention which are believed to be novel are set forth with particularity in the appended claims. The invention, together with further objects and advantages, may best be understood by reference to the following description taken in conjunction with the accompanying drawings, in the several figures of which reference numerals identify like elements, and in which:

DETAILED DESCRIPTION OF A PREFERRED EMBODIMENT OF THE INVENTION

Figure 2:
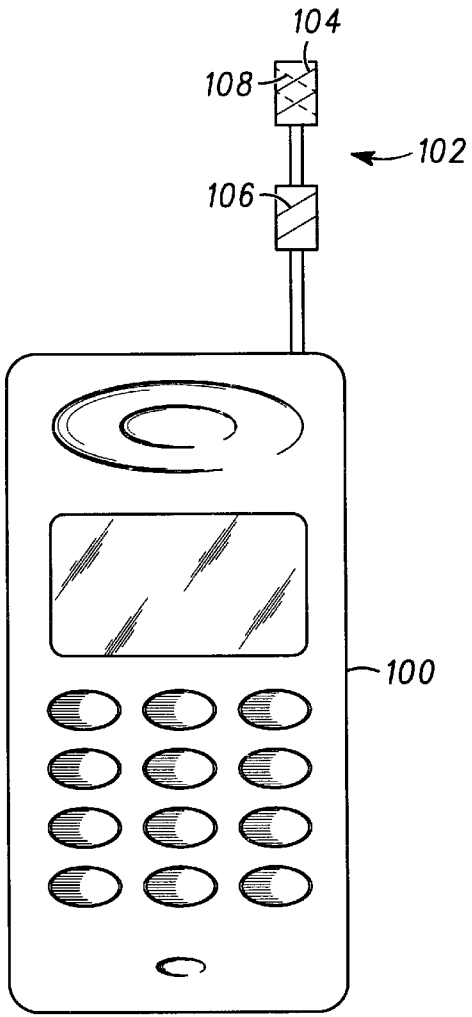
FIG. 2 depicts the FIG. 1 radio subscriber unit in which the antenna of the present invention is deployed.

The present invention is a satellite adaptive antenna system for use in a radio subscriber unit, such as a cell phone or other portable device. The satellite adaptive antenna system can be utilized for reception of signals from a satellite, such as GPS signals, or can be utilized for transmitting and receiving signals between the radio subscriber unit and the satellite.

In general terms, the present invention is a satellite adaptive antenna system having at least spaced apart first and second elements, the first and second elements having substantially a common first polarization. A third element has a second polarization that is opposite the first polarization of the first element. An antenna mode selector system selects between operatively connecting the first and second elements to form a specular antenna (an antenna having a pattern gain mode), and operatively connecting the first and third elements to form a diversity antenna. The present invention is also directed to a method for adapting a satellite antenna system that has the steps of: forming a diversity antenna having a polarization diversity mode defined by first and third elements; forming a specular antenna having a pattern gain mode defined by first and second elements; using the diversity mode for communicating with the satellite; and switching to the specular for communicating with the satellite in response to at least one predetermined characteristic. The method further has the steps of receiving a signal from the satellite, holding a setting for transmitting a signal to the satellite, comparing signals on the first and third antennas, using the diversity antenna for transmitting if the first and third antenna signals are substantially equal, or using the specular antenna for transmission if the first and third signals are not equal.

Each of the first, second and third elements are quadrifilar helix antennas, the first and second elements having right hand circuit polarization and the third element having left hand circuit polarization. A combiner has a first output connected to the first element and a second output connected to a switch for alternately connecting to the third element or the second element.

The system can further have switched diversity circuitry for providing switch diversity between the first and third elements.

For the diversity antenna configuration first and third quadrifilar helix antennas are adjacent one another, and for the specular antenna the first and second quadrifilar helix antennas are spaced apart from one another. As used herein adjacent includes coincident antenna element location. Furthermore, a controllable phase shifter is operatively connected to one of the first and second elements. The selection of the specular antenna or the diversity antenna can be determined by the user or automatically by the antenna system.

Predetermined characteristics used for switching from the diversity antenna to the specular antenna, can be at least one of a fade characteristic of a signal received from a satellite in the diversity mode, at least one of an average power of the signal received from the satellite by the first and third elements in the diversity mode, and a rate of change of the signal received from the satellite in the diversity mode. Furthermore, the predetermined characteristic can be at least one of signal to interference ratio, signal to noise ratio, measured phase, power relationship relative to signals received on the first and third elements, and a gradient phase search relative to signals received from a satellite by the first and second elements in the antenna system.

The first, second and third elements are mounted on an antenna shaft, which in a retracted position defines a diversity mode and in a deployed position defines a specular mode. Although the above described system has been described using quadrifilar helix antennas, stacked patch antennas could be used instead. For a stacked patch antenna array, a top patch antenna has the first and third elements, and a bottom patch antenna has the second element. The stacked patch antenna array operates and functions in the same manner as described above with regards to the quadrifilar helix antennas.

Figure 1:
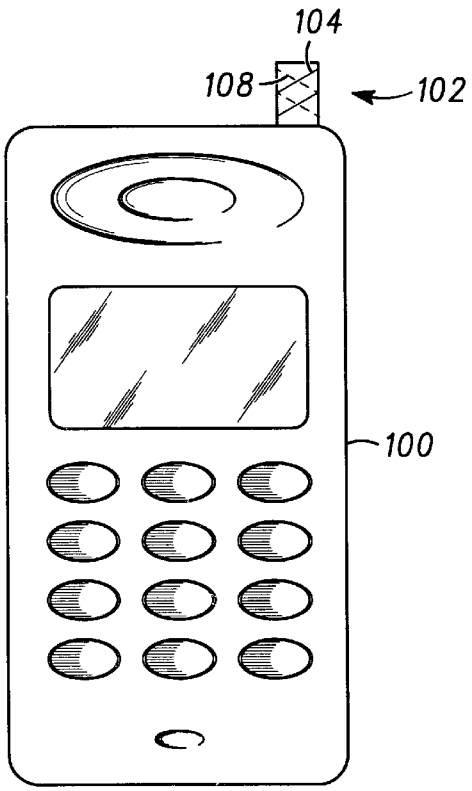
FIG. 1 depicts a radio subscriber unit in which the antenna of the present invention is in a docked position.
Figure 3:
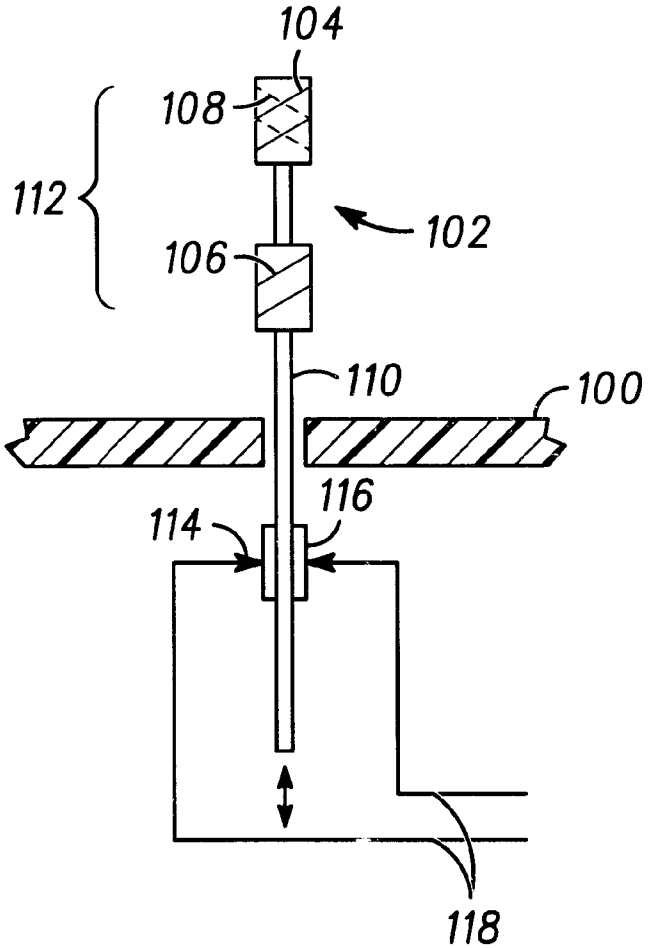
FIG. 3 is a diagram depicting one example of the structure of the antenna system of the present invention.
Figure 9:
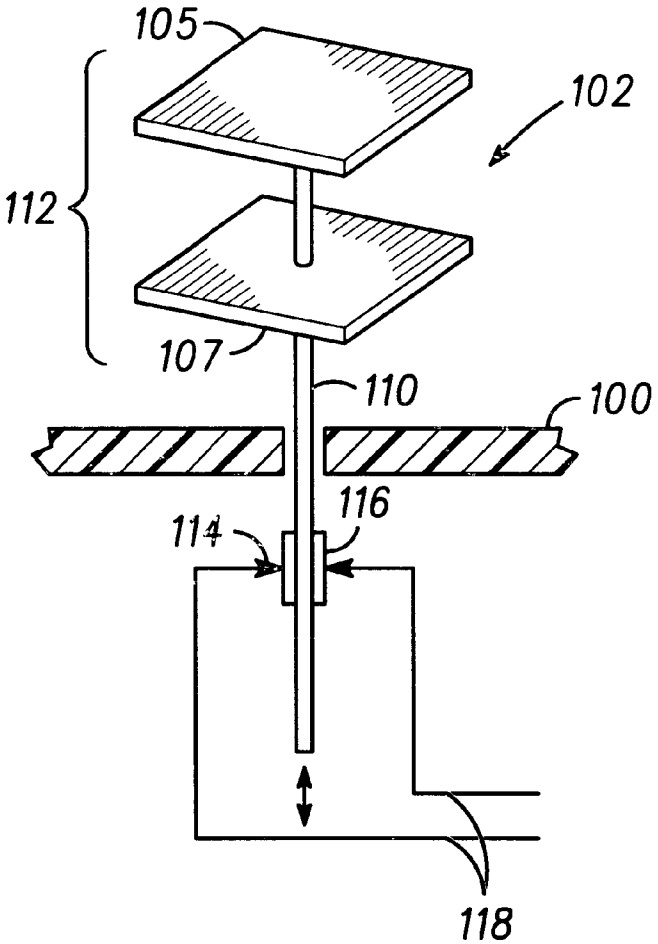

FIGS. 1, 2, 7 and 8 depict a radio subscriber unit 100 in which the inventive antenna 102 is shown in a retracted or docked position in FIG. 1 and in a deployed position in FIG. 2 relative to the housing of the unit 100. In FIGS. 2 and 3, the antenna 102 has first, second and third antenna elements 104, 106 and 108. In FIGS. 2 and 3, the antenna elements 104 and 106 are shown to be quadrifilar helix antennas with right hand circuit polarization. In FIG. 9, the antenna 102 has patch antenna elements 105 and 107. However, the antenna element 108 is shown to be a quadrifilar helix antenna with left hand circuit polarization. In the retracted position depicted in FIG. 1 the antenna uses the first and third elements 104 and 108 to define a polarization diversity mode for a diversity mode antenna, and in the deployed position depicted in FIG. 2 the antenna 102 utilizes the first and second elements 104 and 106 to define a specular mode (also referred to as pattern gain mode, directional pattern mode, and line of sight mode) for a specular antenna. As depicted in FIGS. 1 and 2, the quadrifilar helix antenna for the first and second elements 104 and 106 has a right hand circuit polarization, and a quadrifilar helix antenna 108 for the third element 108 has a left hand circuit polarization. Thus the first and third elements form a common structure as a quadrifilar helix antenna. The first and third elements 104 and 108 are adjacent.

When the antenna 102 is moved from the retracted position to the deployed position, the operation of antenna 102 is switched from the diversity mode to the specular mode by essentially switching between using the first or second elements 104 and 106 with the third element 108. The antenna elements 104, 106 and 108 are mounted on an antenna shaft 110 as depicted in FIG. 3. The spaced distance 112 between the first and second elements 104 and 106 defines the phase difference for the specular antenna. A shaft position sensor 114 detects the presence or absence of contacts 116 on the shaft 110. This provides signals on lines 118 such that the radio subscriber unit can detect when the antenna 102 is either in the retracted position or the deployed position. Various other configurations for detecting the deployed and retracted positions are within the skills of one skilled in the art. Also, the type of antennas used for the first, second and third elements 104, 106 and 108 can be, for example, patch antennas, or other antenna configurations and still be within the scope of the present invention. Also, numerous other constructions are envisioned for deploying the antenna from the retracted position to the deployed position.

Figure 4:
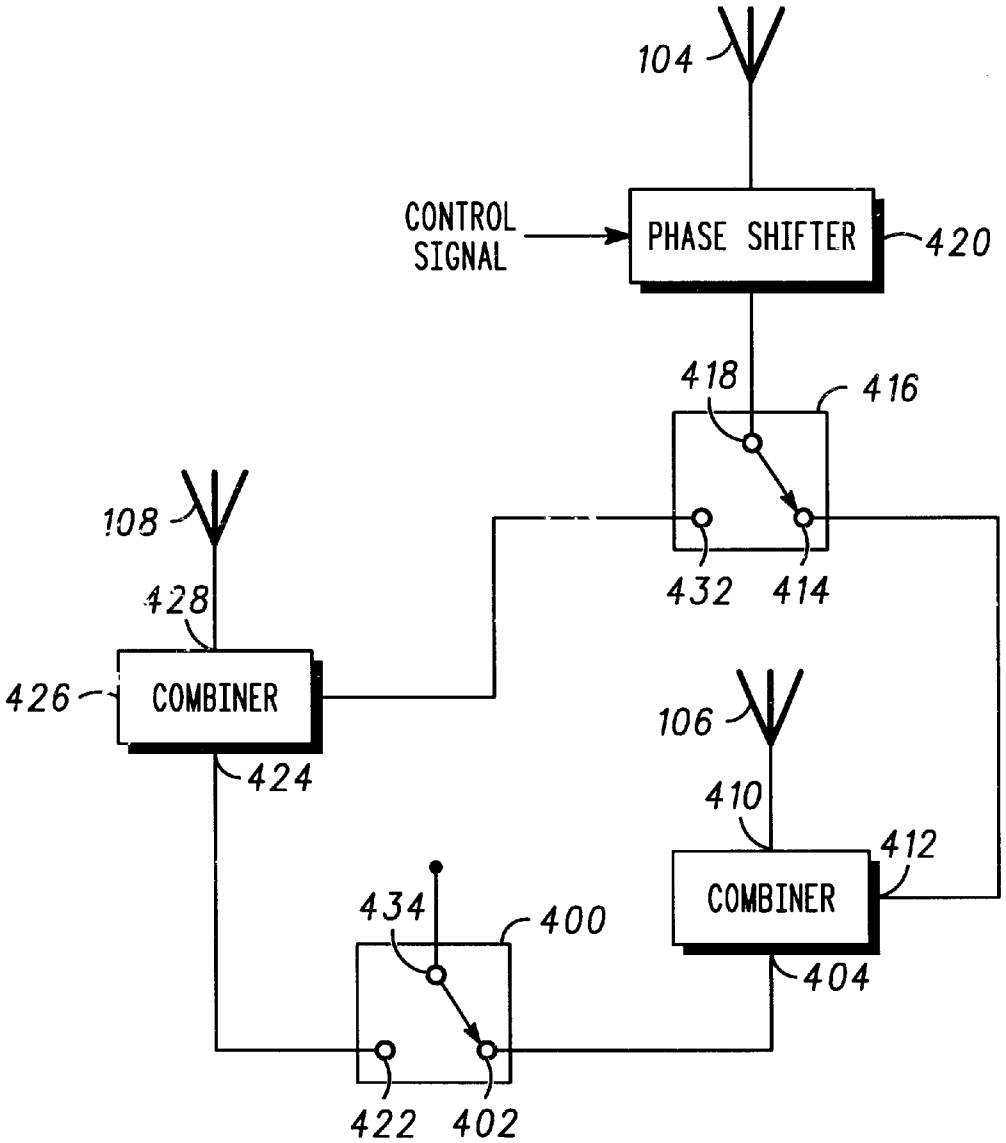
FIG. 4 is a block diagram depicting one example of the antenna system of the present invention.

One example of the satellite adaptive antenna system according to the present invention is depicted in FIG. 4. A first switch 400 has a first terminal 402 connected to an input 404 of a first combiner 406. A first output 410 of the first combiner 406 is connected to the second element 106. A second output 412 of the first combiner 406 is connected to the first input 414 of a second switch 416. A second terminal 418 of the second switch 416 is connected via a phase shifter 420, which receives a control signal, to the first element 104.

A second terminal 422 of the first switch 400 is connected to an input 424 of a second combiner 426. The first output 428 of the second combiner 426 is connected to the third element 108. A second output 430 of the second combiner 426 is connected to a third terminal 432 of the second switch 416. A third terminal 434 of the first switch 400 is connected to the further circuitry in the radio subscriber unit. It is to be noted that reference to input and output is relative to whether signals are being transmitted or received by the radio subscriber unit. The position of the first and second switches 400 and 416 depicted in FIG. 4 defines a pattern gain mode or a specular mode for the antenna system. When the switches 400 and 416 are moved to the other position, then a diversity mode is defined for the antenna system. It is to be noted that the change from the diversity mode to the pattern gain mode or vice versa, is determined by the physical position of the elements 104, 106 and 108. That is, it is determined by whether the antenna is in a retracted or deployed position (see FIG. 3, for example). It is to be further noted that the antenna can be automatically deployed either by a user or in response to a predetermined characteristic.

Figure 5:
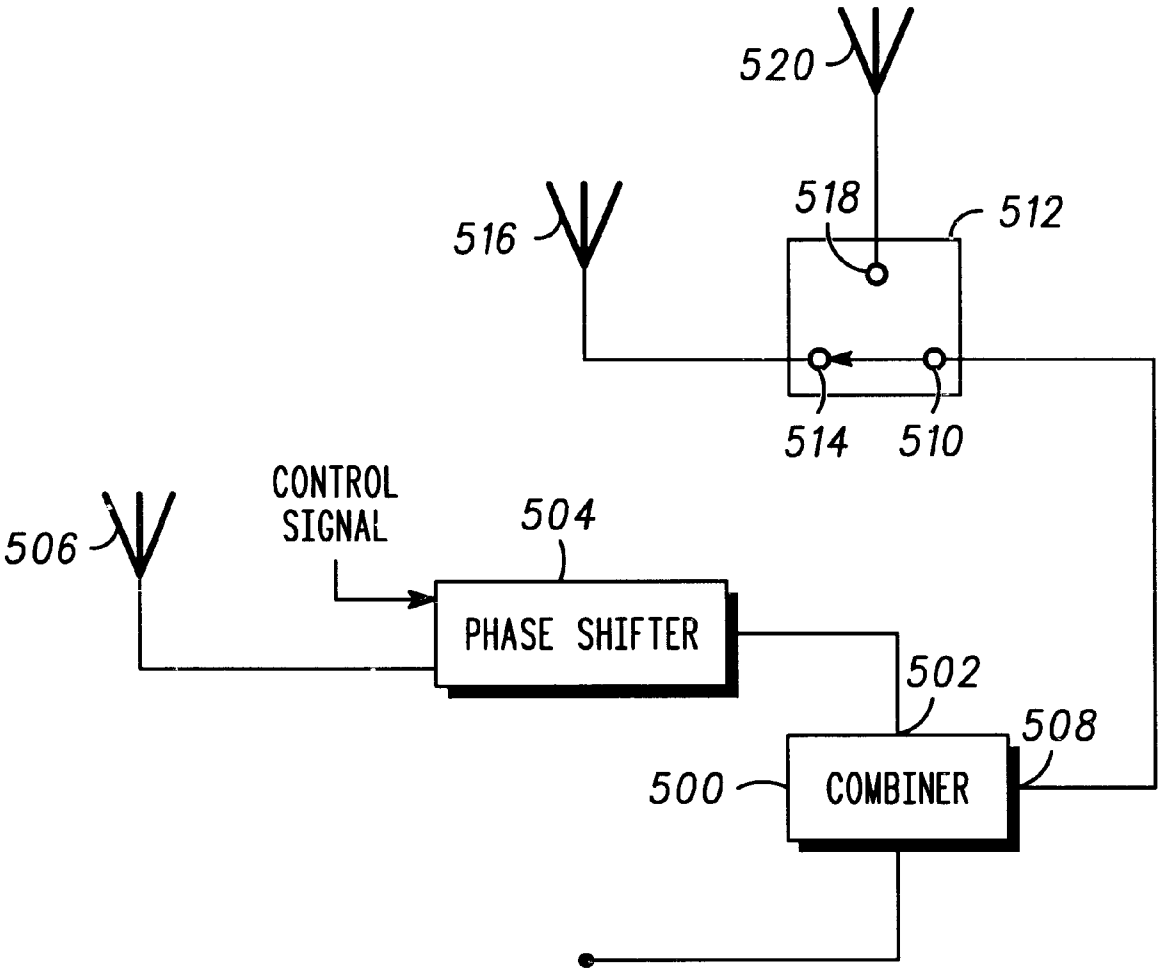
FIG. 5 is a block diagram of another embodiment of the invention.
Figure 8:
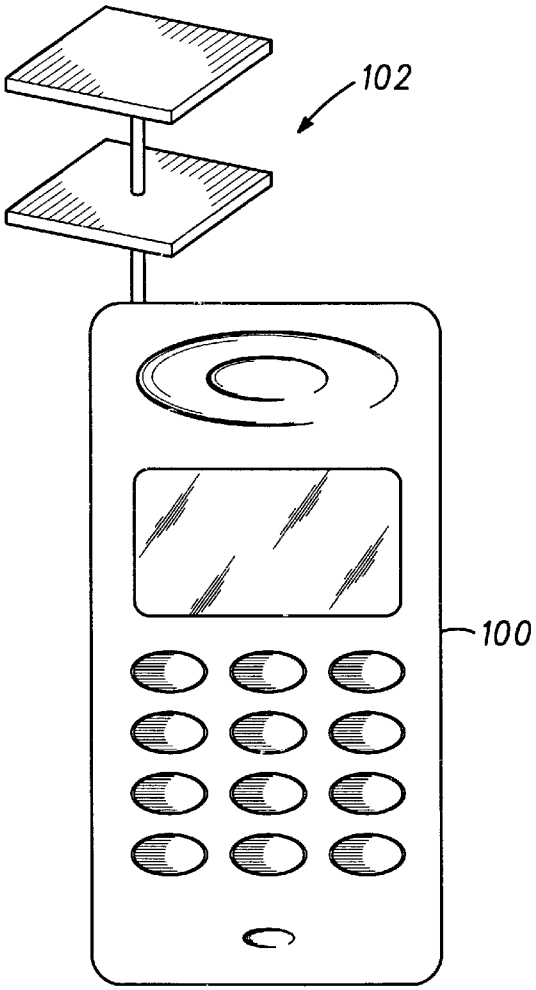
FIGS. 7–9 depict a radio subscriber unit having antennas.
Figure 7:
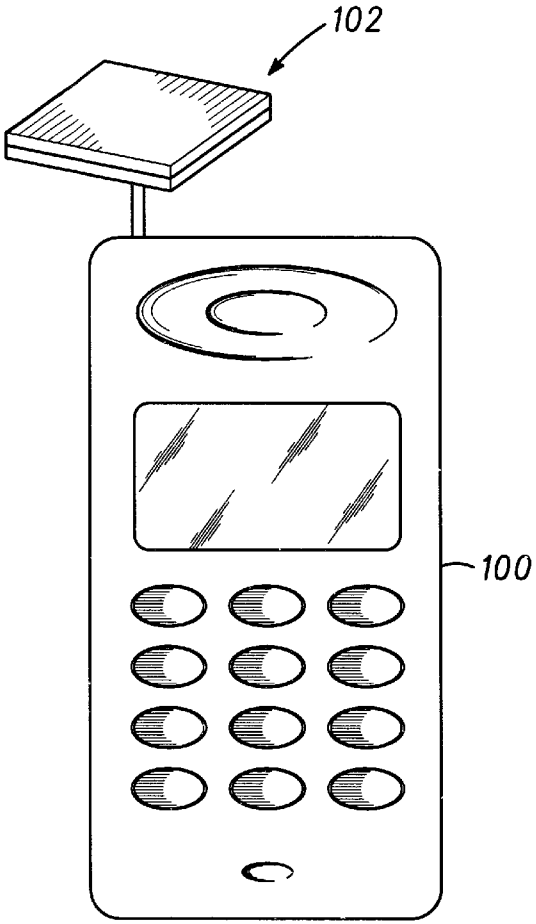

FIG. 5 depicts a more simplified embodiment wherein a combiner 500 has a first output 502 connected, via a phase shifter 504 that receives a control signal, to a first quadrifilar helical antenna element 506. A second output 508 of the combiner 500 is connected to a first terminal 510 of a switch 512. A second terminal 514 of the switch 512 is connected to a third quadrifilar helical antenna element 516. A third terminal 518 of the switch 512 is connected to a second quadrifilar helical antenna 520. With the switch 512 set to the position depicted at FIG. 5 the antenna is in a retracted position and operating in diversity mode using the first and third quadrifilar helical elements 506 and 516. When the switch 512 is moved to the other position, the antenna is in the deployed position and operating in the pattern gain mode using the first and second quadrifilar helical antenna elements 506 and 520.

Figure 6:
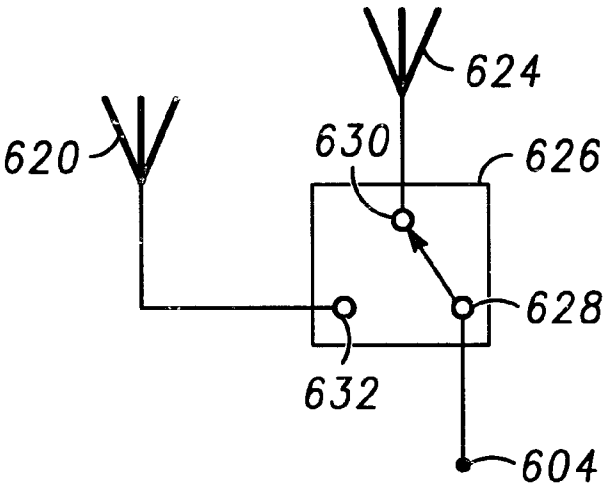
FIG. 6 is another block diagram depicting one example of a switched diversity configuration for use in the present invention.

The diversity mode of operation of the antenna system could also be a switched diversity mode as depicted in FIG. 6. For implementation of the switched diversity mode a switch 626 has a first terminal 628 connected to the input 604, a second terminal 630 connected to the antenna 624, and a third terminal 632 connected to the antenna 620. The antenna 624 corresponds to the first element in the above general description and the antenna 620 corresponds to the third element in the above general description. In switch diversity the circuitry in the radio subscriber unit can utilize, as known in the prior art, either of the antennas 620 and 624.

It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is claimed is:

1. A satellite adapted antenna system, comprising:

at least spaced apart first and second elements, the first and second elements having substantially a common first polarization;

a third element having a second polarization that is opposite the first polarization of the first element; and an antenna mode selector system operatively connecting the first and second elements to form a specular antenna and operatively connecting the first and third elements to form a diversity antenna.

2. The system according to claim 1, wherein each of the first, second and third elements are quadrifilar helix antennas, and wherein the first and second elements are quadrifilar helix antennas having right hand circuit polarization, and wherein the third element is a quadrifilar helix antenna having a left hand circuit polarization.

3. The system according to claim 1, wherein:

the antenna mode selector system has at least a combiner having first and second outputs, the first output connected to the first element; and a switch for operatively connecting a second output of the combiner to the third element or to the second element.

4. The system according to claim 1, wherein the system further comprises a switched diversity circuitry operatively coupled to the first and third elements.

5. The system according to claim 1, wherein the first and third elements form a first quadrifilar helix antenna, and wherein the second element forms a second quadrifilar helix antenna.

6. The system according to claim 5, wherein the first and third quadrifilar helix antennas are adjacent one another to form the diversity antenna, and wherein the first and second quadrifilar helix antennas are spaced apart a predetermined distance to form the specular antenna.

7. The system according to claim 1, wherein the system further comprises a controllable phase shifter operatively connected to one of the first and second elements.

8. The system according to claim 1, wherein the first, second and third elements are antenna elements.

9. The system according to claim 1, wherein the specular antenna has a pattern gain mode.

10. The system according to claim 1, wherein the specular antenna is effected by the second element being a predetermined distance away from the first and third elements, and wherein the diversity antenna is effected by the first and third elements being substantially adjacent to each another.

11. The system according to claim 1, wherein each of the first, second and third elements are patch antennas, and wherein the first and second elements are patch antennas having right hand circuit polarization, and wherein the third element is a patch antenna having a left hand circuit polarization.

12. The system according to claim 1, wherein the first and third elements form a first patch antenna, and wherein the second element forms a second patch antenna.

13. The system according to claim 12, wherein the first and third patch antennas are adjacent one another to form the diversity antenna, and wherein the first and second patch antennas are spaced apart a predetermined distance to form the specular antenna.

14. A method for adapting a satellite antenna system, comprising the steps of:

providing a diversity antenna having a polarization diversity mode defined by first and third elements;

providing a specular antenna having a pattern gain mode defined by first and second elements;

using the diversity mode for communicating with a satellite;

switching to the specular mode for communicating with the satellite in response to at least one predetermined characteristic of a signal from the satellite.

15. The method according to claim 14, wherein the predetermined characteristic is a fade characteristic of the signal received from the satellite in the diversity mode.

16. The method according to claim 14, wherein the predetermined characteristic is at least one of an average power signal received from the satellite by the first and third elements in the diversity mode, and a rate of change of the signal received from satellite in the diversity mode.

17. The method according to claim 14, wherein the first and second elements are right hand circuit polarization quadrifilar helix antennas, and wherein the third element is a left hand circuit polarization quadrifilar helix antenna.

18. The method according to claim 14, wherein the first and third elements form a common structure.

19. The method according to claim 14, wherein the third element is located substantially adjacent the first element to define the diversity mode antenna.

20. The method according to claim 14, wherein the second element is spaced apart a predetermined distance from the first and third elements to define the specular antenna.

21. The method according to claim 14, wherein the satellite antenna system has a housing, and wherein the first, second and third elements are mounted on an antenna shaft, wherein the antenna shaft is retracted relative to the housing to define a diversity mode antenna for the diversity mode, and wherein the antenna shaft is deployed relative to the housing to provide a predetermined distance between the second element and the first and third elements to define a specular mode antenna for the specular mode.

22. The method according to claim 14, wherein the predetermined characteristic is at least one of signal to interference, signal to noise, measured phase, power relationship, and gradient search relative to signals received from a satellite by the first and third elements.

23. The method according to claim 14, wherein the method further comprises the steps of receiving a signal from a satellite, holding a setting for transmitting a signal to the satellite, determining if the first and third antenna signals are substantially equal, using the diversity antenna for transmission if the first and third antenna signals are substantially equal, or using the specular antenna for transmission if the first and third antenna signals are not substantially equal.

24. The method according to claim 14, wherein the first and second elements are right hand circuit polarization patch antennas, and wherein the second element is a left hand circuit polarization patch antenna.

* * * * *